US005954591A

United States Patent [19]

Liberatore

[11] Patent Number: 5,954,591

[45] Date of Patent: Sep. 21, 1999

[54] SPORTS/GOLF TRAINING APPARATUS

[76] Inventor: Anthony Liberatore, P.O. Box 16200-374, Mesa, Ariz. 85211-0374

[21] Appl. No.: 09/146,516

[22] Filed: Sep. 3, 1998

[51] Int. Cl.[6] ..... A63B 69/36

[52] U.S. Cl. ..... 473/206; 473/205; 473/409

[58] Field of Search ..... 473/206, 205, 473/208, 409

[56] References Cited

U.S. PATENT DOCUMENTS

| | | | |
|---|---|---|---|
| 3,806,103 | 4/1974 | Jacques . | |
| 4,361,326 | 11/1982 | Kokwa . | |
| 4,981,297 | 1/1991 | Foster | 473/206 |
| 5,704,845 | 1/1998 | Boyte | 473/206 |

*Primary Examiner*—George J. Marlo
*Attorney, Agent, or Firm*—Cahill, Sutton, & Thomas, P.L.C.

[57] ABSTRACT

Sports equipment "user's grip" enhancing device, especially functional for golf. A portable training device that is molded, cut or formed into a barrel shape that is slipped on the grip of the golf club and modifies the user's grip on the club itself. This device becomes the resting point for the thumb and index finger of the right hand for right handed golfers and the left hand for left-handers. Repositioning the thumb and index finger reduces the amount of unneeded control that these two fingers exert on the club. Traditionally for many golfers, these two fingers dominate the entire grip and trigger the major muscle groups of that side of the body to contribute unneeded, excessive participation throughout the entire golf swing. Thus, these two fingers attempt to total control the speed of the club and aperture of the club face during the swing and the resulting direction of the flight of the ball once struck.

This device could be used in a similar fashion with any sporting equipment that requires a hand grip to inhibit excessive control by any of the user's fingers and allow a more integrated and centralized grip, with even pressure and balanced control being exerted by one or both hands. The new, improved grip on the golf club or other sports grips should assist the player in achieving the desired performance. In the case of golf it would contribute to greater accuracy, predictability, distance as well as, a reduced chance of hooking or slicing the ball.

5 Claims, 2 Drawing Sheets

SPORTS/GOLF TRAINING APPARATUS

TECHNICAL FIELD

This invention provides a simple, portable device that when properly utilized in practice sessions can assist sports/golf in developing a better more functional grip, which will contribute to better distance and accuracy of their shots during actual play.

BACKGROUND ART

Although this device was primarily designed to aid golfers in improving their grip and swing performance of the club, the device can also be used for other sports and equipment that requires a hand grip. This request for patent protection highlights the golf application but the device has alternative uses in other sports as noted in the claims section.

The success of a golf swing requires having the hands in the correct position and exerting effective, balanced pressure on the grip throughout the swing of the club. The hands must function in unison to position the club behind the ball, initiate the back swing, start the downswing, make contact with the ball and complete the follow through. If the hands do not maintain sound, effective control of the club then the accuracy, direction of flight and shot distance is negatively affected, which influences the resulting score of the game.

During most golfers' grips there is a tremendous tendency for the thumb and index fingers of the golfer's dominant hand (right or left) to exert excessive clenching force during the grip to excessively control the club and ultimately the results of the swing. Excessive control by these two fingers can cause the club face aperture to be too far open or closed at the point of impact with the ball causing a push or fade of the shot.

It can also cause the wrists to stay open too long or roll over prematurely causing slicing or hooking. If these two fingers and the related muscle groups of that side of the body excessively dominates the swing, then the golfer will make inconsistent, unpredictable contact with the ball resulting in erratic, undesirable performance.

According to our search there have been no devices that have been awarded Patent protection that are similar to this device. Several patents were researched to find a similar design and these included U.S. Pat. No. 3,806,103 April, 1974 Edward J Jaques U.S. Pat. No. 4,361,326 November 1982 Ivan J. Kokes but none were found to be similar in design or function.

SUMMARY OF INVENTION

This product invention is a portable sport/golf training device (FIG. 1) that is a molded, cut or formed into a barrel shaped cylinder that is slipped onto any the grip of any handle sports grip (baseball, tennis, racquetball, etc.) or golf clubs and modifies the user's grip. This barrel shaped cylinder is hollow in the center with a slit (cut) from end to end allowing it to be slipped over the shaft and slid up onto the grip of any golf club or onto one of the golfer's fingers. The barrel shape allows the thumb and index finger of the dominant hand to rest on top of the device instead of directly on the club grip (FIG. 2). When used properly, this device shifts control from the index finger and thumb and centralizes the key points of pressure on the grip giving both hands more sound control of the club. The key points of pressure actually shift from the far end of the grip of the club to a more central point where the fleshy base of the thumb of the dominant hand exerts pressure downward (FIG. 3) on the thumb of the other hand. This allows more equal participation by the remaining fingers of the dominant hand and all five fingers of the other hand. This change of grip pressure improves the unity and integrity between the two hands and control of distance and direction of the ball after being struck by the golf club.

The device is approximately one and one half inches long and can be produced In different outer and inner diameters for different size hands, conventional golf grip diameters, or over other sports grips. It is slit along the entire length so that it can be slipped over sports equipment grips or golf club shaft and slid upward over the lower part of the golf club grip.

It can be attached to the golf club grip with a press fit, mechanical device or flexible fastener which secures the device in place. The device can be produced by various methods including injection molding, formed or cut out of rubber, resins or materials for different densities or firmness.

The degree of taper, roundness, or length of the barrel shaped device can be modified to conform to different sized hands, fingers and sporting equipment grips of all kinds. This device can also be worn around one finger (FIG. 4) if desired to modify its individual influence on the grip during the swing.

It is possible that this design or shape can be incorporated and built into the grip of any sporting equipment (baseball, tennis, golf, etc.), so that it permanently incorporates the tapered, barrel shape. This version of the invention (FIG. 5) is also claimed in the claims section.

BRIEF DESCRIPTION OF THE DRAWINGS

FIG. 5 Complete grip with device built in

DESCRIPTION OF PREFERRED EMBODIMENTS

Figure 1:
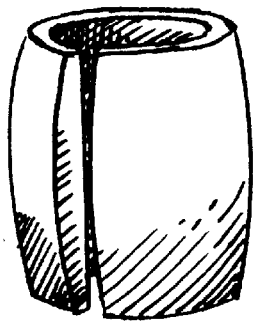
FIG. 1 Device Itself
Figure 2:
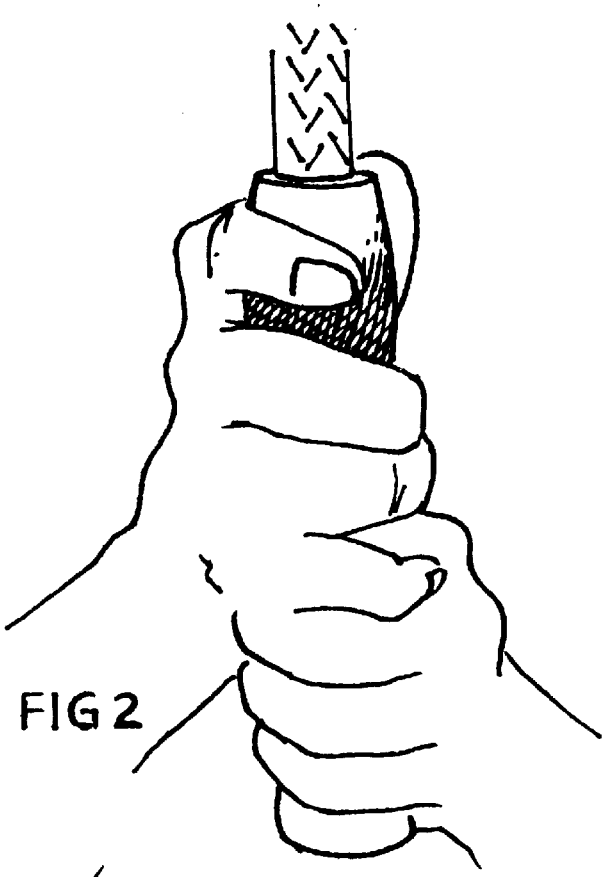
FIG. 2 Front view of hands on club
Figure 3:
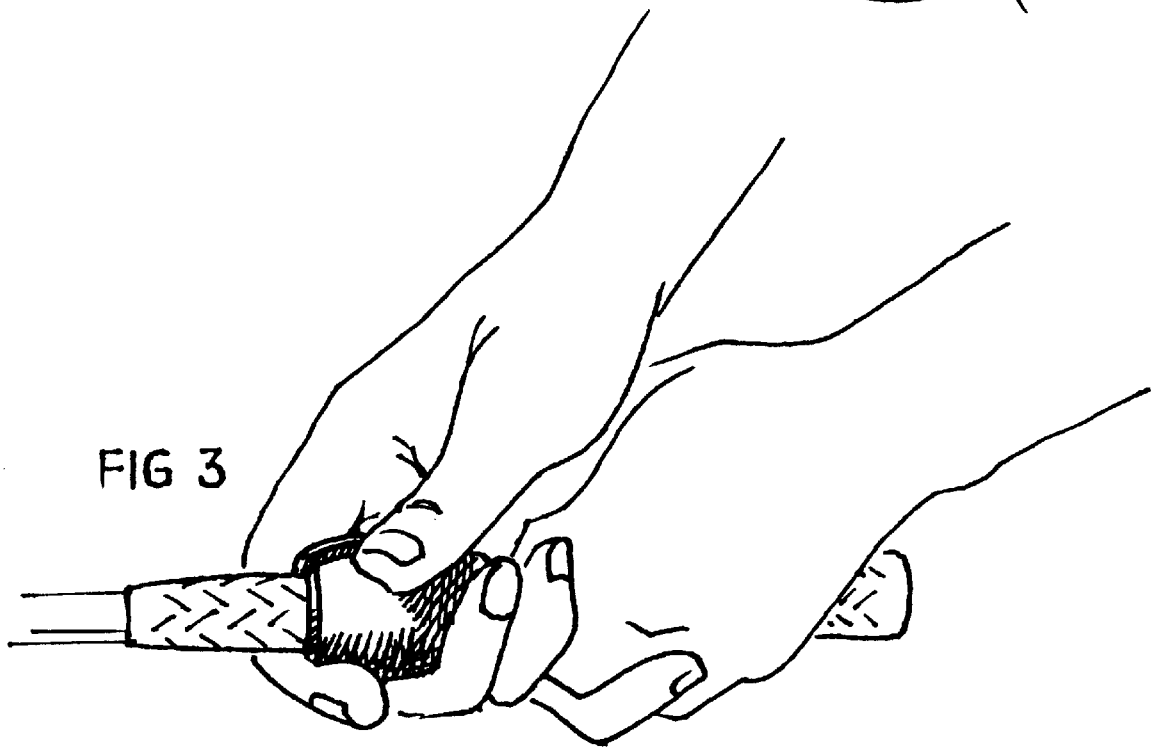
FIG. 3 Side view of hands on the club
Figure 4:
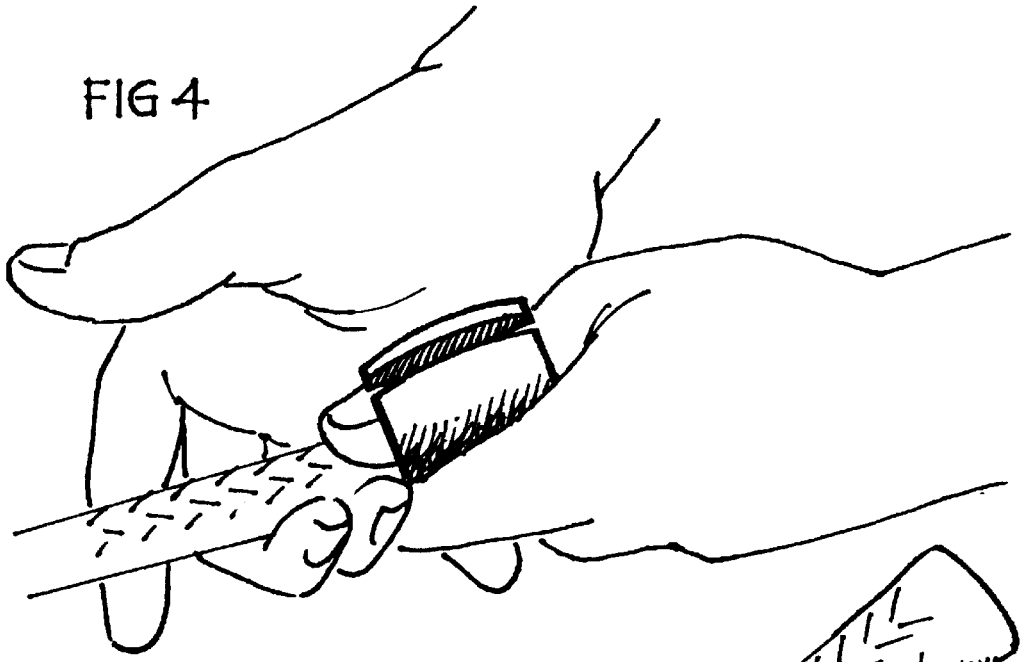
FIG. 4 Device on thumb instead of grip
Figure 5:
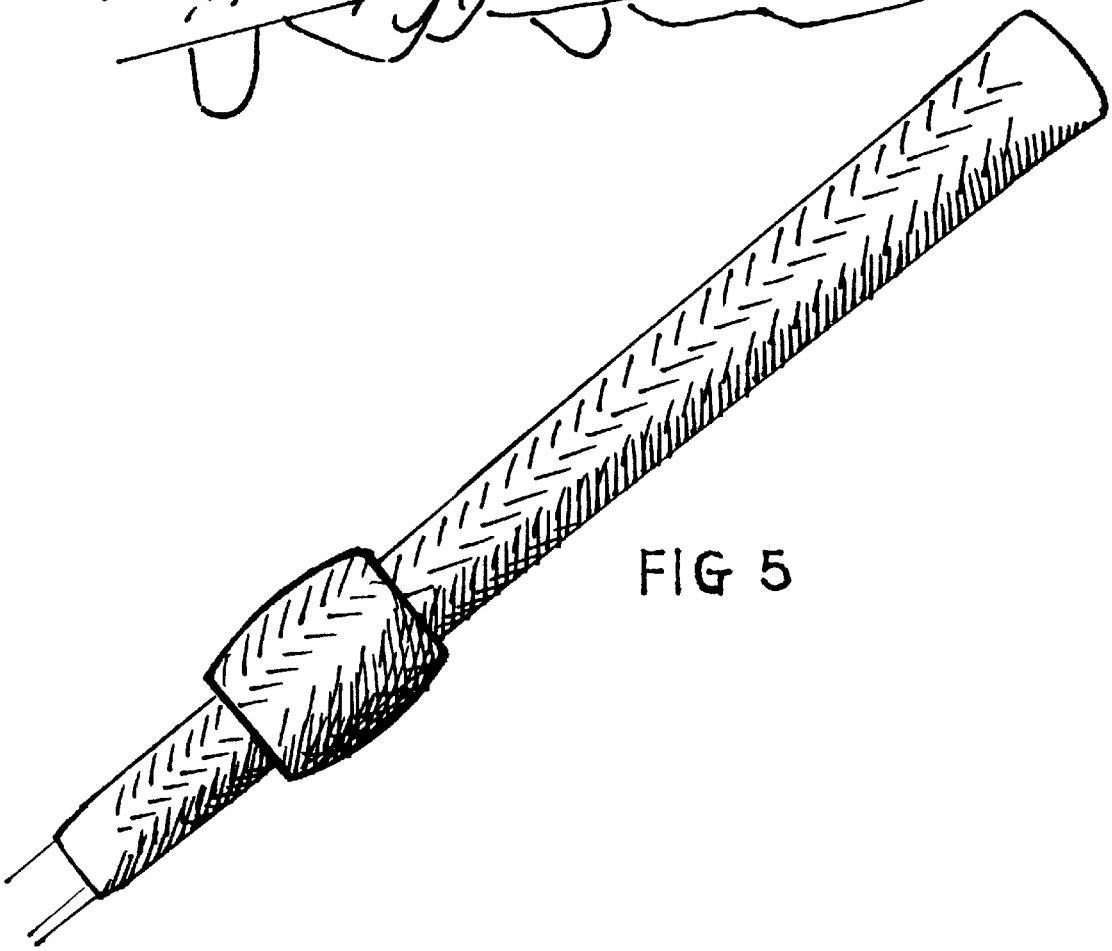

Referring to FIGS. 1,2 & 3 show the invented barrel shaped device and resulting grip modification when using the device are shown. FIG. 4 shows the possibility of the device being attached to a single finger. FIG. 5 shows the device being incorporated or built into a standard golf grip. Patent protection is sought for this newly invented device.

Since the success of a golf swing requires exerting balanced control of the club via the hands on the grip any improvement of the hand's grip on the club is valuable in achieving greater club head control and improved results of the swing. If the control of the club can be improved by changing the physics and dynamics of the hand's grip on the club to make the grip more effective, then the golfer has a greater chance of hitting the desired straighter and longer shot with the club.

Ideally, the purpose of the grip is to have both hands control the take away, downswing and follow-through of the swing. The ultimate goal is for the clubface to return to the same position of squareness at the point of impact with the ball as it had at the point of addressing the ball. This is difficult to accomplish if the thumb and index finger of the dominant hand and the related muscles of that side of the body are exerting excessive pressure or control on the club.

This invention is designed to modify and reduce the amount of excessive pressure and control exerted on the club by the thumb and index finder of the dominant hand, and indirectly the muscles of that dominant side of the body by attaching the inventor's unique barrel shaped device on the grip of the club at the position of the index finger and the thumb, allowing them to rest on the tapered portion of the device and not directly on the Apparatus club grip. By resting the index finger and thumb on the device and not directly on the grip, they have reduced control of the club and allow more pressure to be exerted by the remaining fingers and the palms of both hands. The device also transfers the control point from the end of the grip back to a mid-point between the two hands to the point where the fleshy base of the thumb of the dominant hand makes contact and exerts downward pressure on the thumb of the bottom hand. This shifting of the control point creates a more cooperative, uniform pressure to be applied by both hands and allows:

1) the dominant hand and body muscles to contribute to power and distance, and 2) the other hand to contribute to accuracy and direction.

When the thumb and index finger of the right hand dominate the swing and particularly the downswing, it minimizes the ability of the two hands to work together in unison. The rotation of the club and the club face's degree of being open or closed at the point of impact determines the direction and trajectory of the flight of the golf ball. The club face position at the point of impact is largely determined by the hand position, pressure and fingertip control on the grip exerted during the swing. Having conflicting key control points on the golf grip causes disharmony and causes inconsistent swing patterns of the club.

Excessive control by the thumb and index finger is also the primary cause of "casting" the club (like a fishing rod) which causes slicing of the ball. Reducing the excessive control of these two fingers also reduces the risk of rolling the wrists, and helps in creating a straighter flight trajectory. The resulting proper gripping of the club, and wrist rotation improves predictability of the swing, resulting golf ball direction and distance being improved.

What is claimed in this patent application is detailed as follows:

1. A training device to improve a user's grip on a shaft of sports equipment, said training device comprising:

a. a barrel-shaped element of resilient material extending between first and second opposing ends and having an outer surface, the barrel-shaped element having a characteristic length as measured between its first and second opposing ends, the barrel-shaped element having a central region between said first and second opposing ends;

b. said barrel-shaped element having a longitudinal central axis extending between said first and second opposing ends, and having a central bore formed therein extending along and coincident with said longitudinal central axis, a portion of the outer surface of said barrel-shaped element lying in a plane perpendicular to said longitudinal central axis defining a generally circular curve concentric with said longitudinal central axis at any point along said longitudinal central axis, said generally circular curve of said outer surface having a diameter that is larger within the central region of said barrel-shaped element than at either of the first or second opposing ends;

c. said barrel-shaped element having a slit formed in the outer surface thereof, said slit extending between said first and second opposing ends thereof and communicating with said central bore, said slit facilitating the insertion of said training device over and around the shaft of said sports equipment;

d. said characteristic length of said barrel-shaped element being greater than the diameter of the outer surface of the barrel-shaped element within the central region thereof.

2. The training device recited by claim 1 wherein said characteristic length is approximately one and one-half inches long.

3. The training device recited by claim 1 wherein said slit is relatively narrow for allowing the outer surface of said barrel-shaped element to be substantially continuous.

4. A golf club and related training device for improving a user's grip on said golf club, comprising in combination:

a. a golf club including a head for hitting a golf ball, a shaft, and a grip opposite said head;

b. a training device including a barrel-shaped element of resilient material extending between first and second opposing ends and having an outer surface, the barrel-shaped element having a characteristic length as measured between its first and second opposing ends, the barrel-shaped element having a central region between said first and second opposing ends;

c. said barrel-shaped element having a longitudinal central axis extending between said first and second opposing ends, and having a central bore formed therein extending along and coincident with said longitudinal central axis, a portion of the outer surface of said barrel-shaped element lying in a plane perpendicular to said longitudinal central axis defining a generally circular curve concentric with said longitudinal central axis at any point along said longitudinal central axis, said generally circular curve of said outer surface having a diameter that is larger within the central region of said barrel-shaped element than at either of the first or second opposing ends;

d. said barrel-shaped element having a slit formed in the outer surface thereof, said slit extending between said first and second opposing ends thereof and communicating with said central bore, said slit facilitating the insertion of said training device over and around the grip of said golf club; and e. said characteristic length of said barrel-shaped element being greater than the diameter of the outer surface of the barrel-shaped element within the central region thereof.

5. A method of improving a golfer's golf swing of a golf club, the golf club including a head for hitting a golf ball, a shaft, and a grip opposite said head, said method comprising the steps of:

a. mounting a barrel-shaped element of resilient material over and around the grip of the golf club, the barrel-shaped element extending between first and second opposing ends along a central longitudinal axis, having a central bore formed therein and extending along the central axis and coincident therewith, and having an outer surface, the barrel-shaped element having a central region disposed between the first and second opposing ends, the outer surface of the barrel-shaped element within the central region thereof being bowed outwardly relative to the outer surface of the barrel-shaped element proximate the first or second having a slit formed in the outer surface thereof, the slit extending between said first and second opposing ends thereof and communicating with the central bore, the slit facilitating the insertion of the training device over and around the grip of the golf club, the barrel-shaped element having a characteristic length as measured between its first and second opposing ends, the barrel-shaped element also having a characteristic diameter measured about its outer surface within a plane perpendicular to its central longitudinal axis, the characteristic length of the barrel-shaped element being greater than the diameter of the outer surface of the barrel-shaped element within the central region thereof; and b. grasping the golf club grip and barrel-shaped element in a manner wherein the user's hand that is furthest from the head of the golf club extends about the golf club grip, while the thumb and index finger of the user's hand that is closest to the head of the golf club are positioned upon the barrel-shaped element, rather than upon the golf club grip itself, for reducing excessive pressure and excessive control of the user's thumb and index finger of the user's hand that lies closest to the head of the golf club; and c. swinging the club to hit a golf ball while maintaining the thumb and index finger of the user's hand that is closest to the head of the golf club upon the barrel-shaped element.

* * * * *